US007938564B2

(12) United States Patent
Kwong et al.

(10) Patent No.: US 7,938,564 B2
(45) **Date of Patent: *May 10, 2011**

(54) LAMP WITH SPOT LIGHT AND FLOOD LIGHT FEATURES

(75) Inventors: Allan Hing Chuen Kwong, Shatin (HK); Richard Takata, Newport Beach, CA (US)

(73) Assignee: Gardenia Industrial Limited, Kowloon (HK)

( * ) Notice: Subject to any disclaimer, the term of this patent is extended or adjusted under 35 U.S.C. 154(b) by 0 days.

This patent is subject to a terminal disclaimer.

(21) Appl. No.: 11/523,260

(22) Filed: Sep. 19, 2006

(65) Prior Publication Data

US 2007/0008728 A1 Jan. 11, 2007

Related U.S. Application Data

(63) Continuation of application No. 10/951,195, filed on Sep. 27, 2004, now Pat. No. 7,198,389.

(51) Int. Cl.
*F21V 5/00* (2006.01)

(52) U.S. Cl. ..... 362/329; 362/307; 362/310; 313/313; 313/318.11; 313/318.12

(58) Field of Classification Search ..... 362/260–263, 362/296, 298–300, 307–308, 310, 326–327, 362/329, 351, 353, 355, 341, 296.01; 313/113–115, 313/318.11–318.12, 317

See application file for complete search history.

(56) References Cited

U.S. PATENT DOCUMENTS 1,596,725 A * 8/1926 Ferree ..... 362/307
2,182,155 A * 12/1939 Martin ..... 340/815.76
2,362,171 A 11/1944 Swanson
2,596,697 A 5/1952 Krefft
3,330,951 A 7/1967 Neal
3,401,258 A 9/1968 Guth
3,932,780 A * 1/1976 DeCaro et al. ..... 313/113
4,506,316 A 3/1985 Thiry et al.
4,755,916 A 7/1988 Collins
4,761,721 A 8/1988 Willing
D302,863 S 8/1989 Krol
4,870,551 A 9/1989 Nagel
4,953,062 A * 8/1990 Sikora et al. ..... 362/263
5,036,244 A * 7/1991 Shaffer ..... 313/116
5,057,735 A 10/1991 Zalar et al.
D325,994 S 5/1992 Hume et al.
5,199,787 A 4/1993 King et al.

(Continued)

OTHER PUBLICATIONS

Complaint, *Gardenia Industrial Limited* v. *Feit Electric Company, Inc.*, U.S. District Court, Northern District of Georgia, Atlanta Division, Civil Action No. 1:07-CV-2672-JTC (Oct. 26, 2007).

(Continued)

*Primary Examiner* — Jason Moon Han
(74) *Attorney, Agent, or Firm* — Baker Donelson Bearman Caldwell & Berkowitz PC

(57) ABSTRACT

A lamp with combined spot and flood light distribution properties in which an elongate translucent shell defines an interior cavity with a reflector portion and a neck portion. A socket-engaging base includes a pair of electrical contact members for communicating with respective electrical contacts of a socket of a light fixture. A lamp capsule, disposed in the interior cavity, includes a light source that connects to a pair of electrical leads for connecting to electrical contact members of the socket. The light emitted from the light source communicates difusingly radially omni-directionally through the neck portion and directedly substantially longitudinally from the reflector portion.

18 Claims, 2 Drawing Sheets

U.S. PATENT DOCUMENTS

| | | | | |
|---|---|---|---|---|
| 5,353,210 | A | 10/1994 | Strok et al. | |
| D379,537 | S | 5/1997 | Gallant et al. | |
| 5,703,428 | A | 12/1997 | Borgis | |
| D398,407 | S | 9/1998 | O'Connell | |
| 5,826,970 | A | 10/1998 | Keller et al. | |
| 6,004,003 | A | 12/1999 | Dalton | |
| 6,053,623 | A | 4/2000 | Jones et al. | |
| 6,147,444 | A | 11/2000 | Gallant et al. | |
| 6,218,785 | B1 * | 4/2001 | Incerti | 315/185 S |
| D467,358 | S | 12/2002 | Morris | |
| 6,502,953 | B2 | 1/2003 | Hajianpour | |
| D470,607 | S | 2/2003 | Bobel | |
| 6,739,737 | B2 | 5/2004 | Yu | |
| 6,781,318 | B2 | 8/2004 | Lapatovich et al. | |
| D498,310 | S | 11/2004 | Gagnon et al. | |
| 6,922,008 | B2 | 7/2005 | Zhao | |
| D516,229 | S | 2/2006 | Tang | |
| D539,443 | S | 3/2007 | Kwong | |
| 2004/0190295 | A1 | 9/2004 | Andorfer et al. | |
| 2005/0018432 | A1 | 1/2005 | Buschmann et al. | |

OTHER PUBLICATIONS

Answer, *Gardenia Industrial Limited* v. *Feit Electric Company, Inc.*, U.S. District Court, Northern District of Georgia, Atlanta Division, Civil Action No. 1:07-CV-2672-JTC (Apr. 9, 2008).

Joint Claim Construction Statement, *Gardenia Industrial Limited* v. *Feit Electric Company, Inc.*, U.S. District Court, Northern District of Georgia, Atlanta Division, Civil Action No. 1:07-CV-2672-JTC (Dec. 1, 2008).

Feit Claim Construction Brief, *Gardenia Industrial Limited* v. *Feit Electric Company, Inc.*, U.S. District Court, Northern District of Georgia, Atlanta Division, Civil Action No. 1:07-CV-2672-JTC (Dec. 31, 2008).

Gardenia Claim Construction Brief, *Gardenia Industrial Limited* v. *Feit Electric Company, Inc.*, U.S. District Court, Northern District of Georgia, Atlanta Division, Civil Action No. 1:07-CV-2672-JTC (Dec. 31, 2008).

Gardenia Responsive Brief in Support of Claim Construction, *Gardenia Industrial Limited* v. *Feit Electric Company, Inc.*, U.S. District Court, Northern District of Georgia, Atlanta Division, Civil Action No. 1:07-CV-2672-JTC (Jan. 20, 2009).

Feit Response to Gardenia Claim Construction Brief, *Gardenia Industrial Limited* v. *Feit Electric Company, Inc.*, U.S. District Court, Northern District of Georgia, Atlanta Division, Civil Action No. 1:07-CV-2672-JTC (Jan. 20, 2009).

Don's Bulbs, 2-pin / 2-lug type bulb bases, Don's Bulbs, www.donsbulbs.com, 5 pages (prior to Dec. 10, 2004).

Don's Bulbs, GU10 base, Don's Bulbs, www.donsbulbs.com/bulbs/g/b/gu10.gif, (prior to Dec. 10, 2004).

Don's Bulbs, MR16 bulb, Don's Bulbs, www.donsbulbs.com/bulbs/g/g/mr-16.gif, (prior to Dec. 10, 2004).

PEC Lamp Online Store, 50W MR16 Wide Open 120V GU10, webpage image from http://store.peclamp.com/331033.html (at least prior to Jun. 4, 2005).

The Home Depot, Philips 120 Volt 75 Watt ER-30 Glass Incadescent Bulb, webpage image from www.hopedepot.com/pre180/HDUS/EN_US/shop_cart/pg_print_product.jsp?CNTTY, 2005.

The Home Depot, Philips 45 Watt Floodlight PAR16 Halogen Bulb, webpage image from www.hopedepot.com/pre180/HDUS/EN_US/shop_cart/pg_print_product.jsp?CNTTY, 2005.

The Home Depot, Philips 60 Watt Halogen PAR 16 Flood Bulb, webpage image from www.hopedepot.com/pre180/HDUS/EN_US/shop_cart/pg_print_product.jsp?CNTTY, 2005.

The Home Depot, Philips 120 Volt 75 Watt BR-30 Glass Incandescent Bulb, webpage image from www.hopedepot.com/pre180/HDUS/EN_US/shop_cart/pg_print_product.jsp?CNTTY, 2005.

The Home Depot, Philips 50 Watt Halogen PAR 20 Spot Bulb, webpage image from www.hopedepot.com/pre180/HDUS/EN_US/shop_cart/pg_print_product.jsp?CNTTY, 2005.

The Home Depot, Philips 20 Watt 12 Volt MR-16 Tungsten Halogen Bulb, webpage image from www.hopedepot.com/pre180/HDUS/EN_US/shop_cart/pg_print_product.jsp?CNTTY, 2005.

Philips Lighting Company, Lamp Specification & Application Guide 2004, Philips Lighting Company, 200 Franklin Square Drive, Somerset, NJ 08875-6800, pp. 5, 8, 10, 11, 39, 49, 50, 96, with cover page, "How To Use" page, and Table of Contents, 2004.

Philips Lighting Company, Philips Flood/Spot Mini-Reflector Bulb, webpage www.nam.lighting.philips.com/US/Consumer/products_duramax_IFSR.php (access thru "Find the bulb you need" by the shape, 2004.

Philips Lighting Company, Philips DuraMax Long Life Reflectors, Philips Lighting, Markham, Ontario, Canada, brochure, Jul. 2004.

JDR GU10 Halogen, MR-16 Reflector; Standard base, Intermediate base, GU10 base, Flood; Feit Electric Company, 4901 Gregg Road, Pico Rivera, CA (2003).

Feit Electric Catalog, Reflector R-14/R-16 Mini; R-20; pp. 66-68; Feit Electric Company, 4901 Gregg Road, Pico Rivera, CA 90660-2108 (1997).

Correspondence re Gu10-COATED; FEIT0001; Feit Electric Company, 4901 Gregg Road, Pico Rivera, CA 90660-2108; (Sep. 27, 2004).

Correspondence re BPQ35MR11/IF/GU10/3; FEIT0002; Feit Electric Company, 4901 Gregg Road, Pico Rivera, CA 90660-2108; (Nov. 5, 2004).

Correspondence re card drafts for frosted GU10; FEIT0003-4; Feit Electric Company, 4901 Gregg Road, Pico Rivera, CA 90660-2108; (Jan. 20, 2005).

Feit Electric Label for MR11 GU10 Frost Halogen bulbs; FEIT0005; Feit Electric Company, 4901 Gregg Road, Pico Rivera, CA 90660-2108 (undated).

Luxtex General Catalogue 2000; JDR and JCDR Dichoric Reflector AC Halogen Lamps; SuperTrend Lighting LTD; FEIT0006-7 (2000).

USHIO MR-16 Reflector Lamps; USHIO American, Inc., www.ushio.com; FEIT0088-89 (undated).

* cited by examiner

LAMP WITH SPOT LIGHT AND FLOOD LIGHT FEATURES

This application is a continuation of U.S. patent application Ser. No. 10/951,195, filed Sep. 27, 2004, issued as U.S. Pat. No. 7,198,389.

TECHNICAL FIELD

The present invention relates to lamps. More particularly the present invention relates to reflector lamps providing spotlight features in combination with diffused flood light characteristics.

BACKGROUND OF THE INVENTION

In recent years, track lighting fixtures have become increasingly popular for both ornamental affect in interior design for lighting room interiors as well as featured lighting for illuminating specific portions of cabinets, artwork, and the like. Track lighting fixtures include an adapter that detachably engages the fixture to the track having electrical conductors for communicating electrical current to the lamp held within the fixture. The fixtures include an ornamental housing that encloses the lamp seated in a socket of the fixture. Light emits through an open end of the housing opposing the closed end having the socket for the lamp. The track lighting fixtures typically are metallic or opaque to light transmission except from the open end. Often the fixtures include pivoting and/or rotational connections whereby the housing can be selectively oriented relative to the track for directing the light in a particular direction.

The lamps used in such fixtures are often of a spot-light type lamp. The lamp includes a reflector portion and a neck portion. The light is generally emitted in a concentrated manner from the lamp. These lamps include a reflective surface on the interior of the lamp housing. The reflective surface directs the light emitted by the bulb within the lamp forwardly in the concentrated light pattern. The reflector portion can be parabolic, spherical, elliptical, or other surface providing optically reflective characteristics.

In contrast, a broader, general area illumination is provided by flood-type lamps or conventional lamps having omni-directional light dispersion characteristics. These lamps lack an interior reflective surface. These lamps disperse light generally about the lamp for area illumination.

Recently, track lighting fixtures have been available with translucent glass or ceramic shades. The illuminative effect from these translucent shades has been found unsatisfactory when used with spot-light type lamps. A forward portion of the shade is partially illuminated with light from conventional spot lamps while a base portion of the shade has a darker appearance. While a conventional bulb could be used providing illuminative effect over a greater portion of the shade, the fixture no longer would be as satisfactory when functioning for spot light applications.

Accordingly, there is a need in the art for an improved lamp directed to providing spot light features together with flood light characteristics. It is to such that the present invention is directed.

SUMMARY OF THE INVENTION

The present invention meets the need in the art by providing a lamp having structure that provides combined functional spot light and flood light distribution properties in which an extended elongate translucent shell allows light to pass through diffusely and enclosing a longitudinally extending interior cavity, the shell having (1) a first portion with opposing ends having a first diameter and a second diameter in which the first diameter is greater than the second diameter, the first portion including a reflective coating on an interior surface of the shell so that light in the first portion of the cavity is directed by the reflective coating substantially longitudinally from an end of the shell; and (2) a second portion is frustroconical defined by opposing ends having the second diameter and a third diameter in which the second diameter is greater than the third diameter, said second portion and lacking a reflective coating so that light in the second portion of the cavity emits diffusely in many directions from the second portion of the shell. A socket-engaging base attaches at the second end and includes a pair of electrical contact members for communicating with respective electrical contacts of a socket of a light fixture. An omni-directional light source, disposed in the interior cavity, connects in electrical communication with the electrical contact members. The light emitted from the light source communicates in the first portion substantially longitudinally from the end of the shell and in the second portion diffusingly in many directions through the shell.

Objects, advantages, and features of the present invention will become apparent upon reading the following detailed description in conjunction with the drawings and the appended claims.

DETAILED DESCRIPTION

Figure 1:
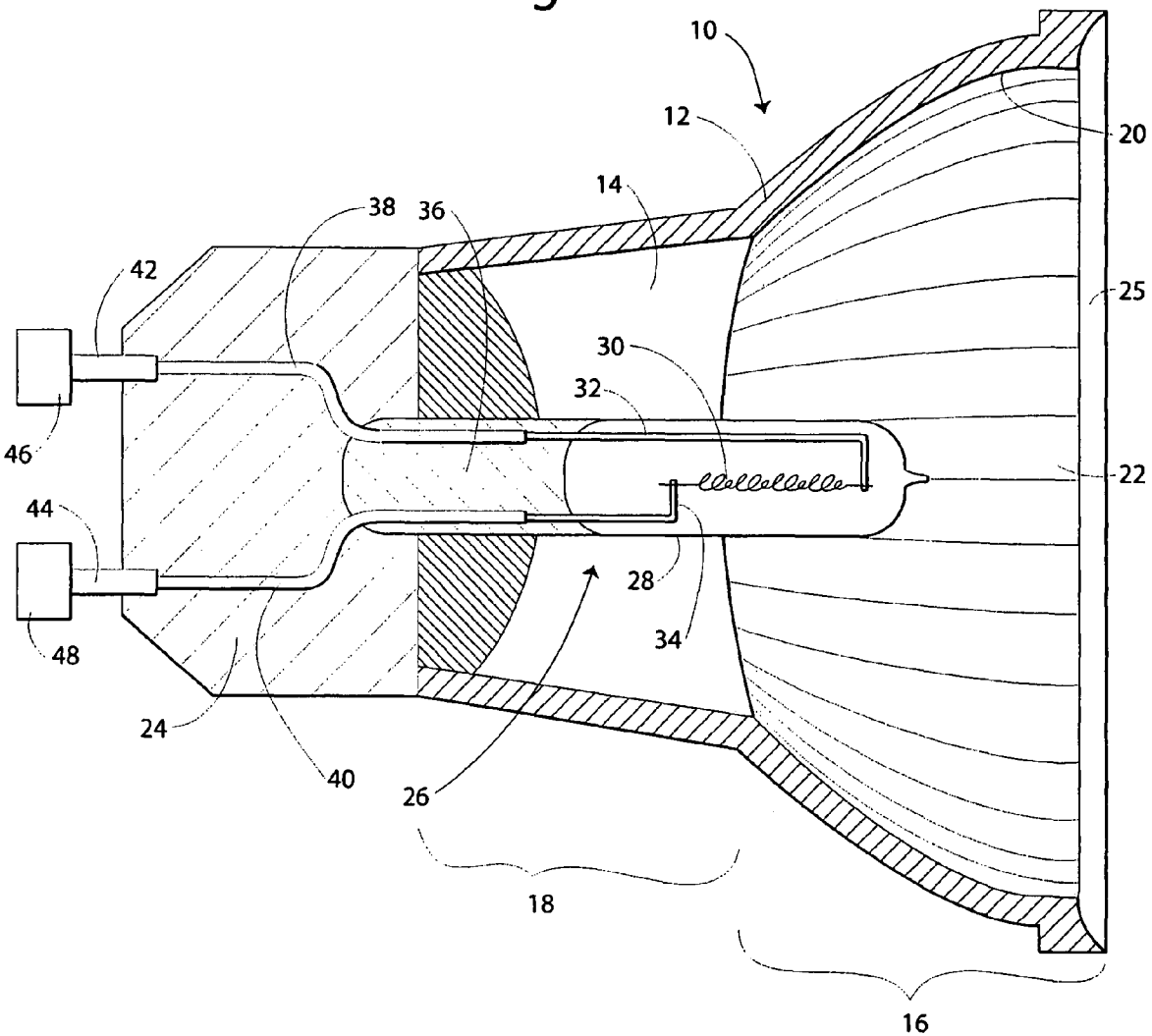
FIG. 1 is a side cross-sectional view of a lamp according to the present invention.

Referring now in more detail to the drawings, in which like parts have like identifiers, FIG. 1 illustrates a side cross-sectional view of a lamp 10 that upon illumination by electrical current, emits light having combined spot and flood light distribution properties. The lamp 10 comprises an elongate translucent shell 12 that defines an interior cavity 14. The shell 12 defines a reflector portion 16 and a flood portion 18. The reflector portion 16 includes a light reflecting surface 20 that extends from a light emitting end 22 to the flood portion 18 generally intermediate the end 22 and a base 24. The light emitting end 22 can be open. The illustrated embodiment provides a tungsten-halogen light source, so the end 22 is closed by a halogen appropriate glass lens 25. In the illustrated embodiment, the reflector portion 18 is frustroconical in cross-sectional view having a major diameter at the end 22 and a minor diameter at the transition to the flood portion 16. The interior surface of the shell 12 in the reflector portion 16 includes grooves and ridges to provide additional facets or reflective surfaces for communication of light from the end 22.

The flood portion 18 in the illustrated embodiment defines a second frustroconical shape in cross-sectional view with a major diameter at the transition with the reflector portion 16 and a minor diameter at the connection of the flood portion 18 with the base 24. The inner surface of the shell lacks a reflective or opaque surface, allowing light to communicate through the shell 12.

A light source generally 26 mounts in the interior cavity 14. The light source comprises a light capsule 28 or glass envelope that houses a light emitter or filament 30 connected to wire supports 32, 34 held in a potting material 36. The light capsule 28 is disposed so that a respective portion aligns with the reflector portion 16 and with the flood portion 18. The wire supports 32, 34 connect to electrical leads 38, 40 that extend outwardly of the light capsule 28. The leads 38, 40 connect to electrical contacts 42, 44 in the base 24. In the illustrated embodiment, the electrical contacts 42, 44 are metal pins disposed in passageways in the base 24 and extend longitudinally from the base 24. The electrical contacts 42, 44 terminate in feet 44, 46. The feet 46, 48 have diameters greater than the diameters of the pins 42, 44. Other electrical contacts could be used, such as bayonet, screw, or other type.

Figure 2:
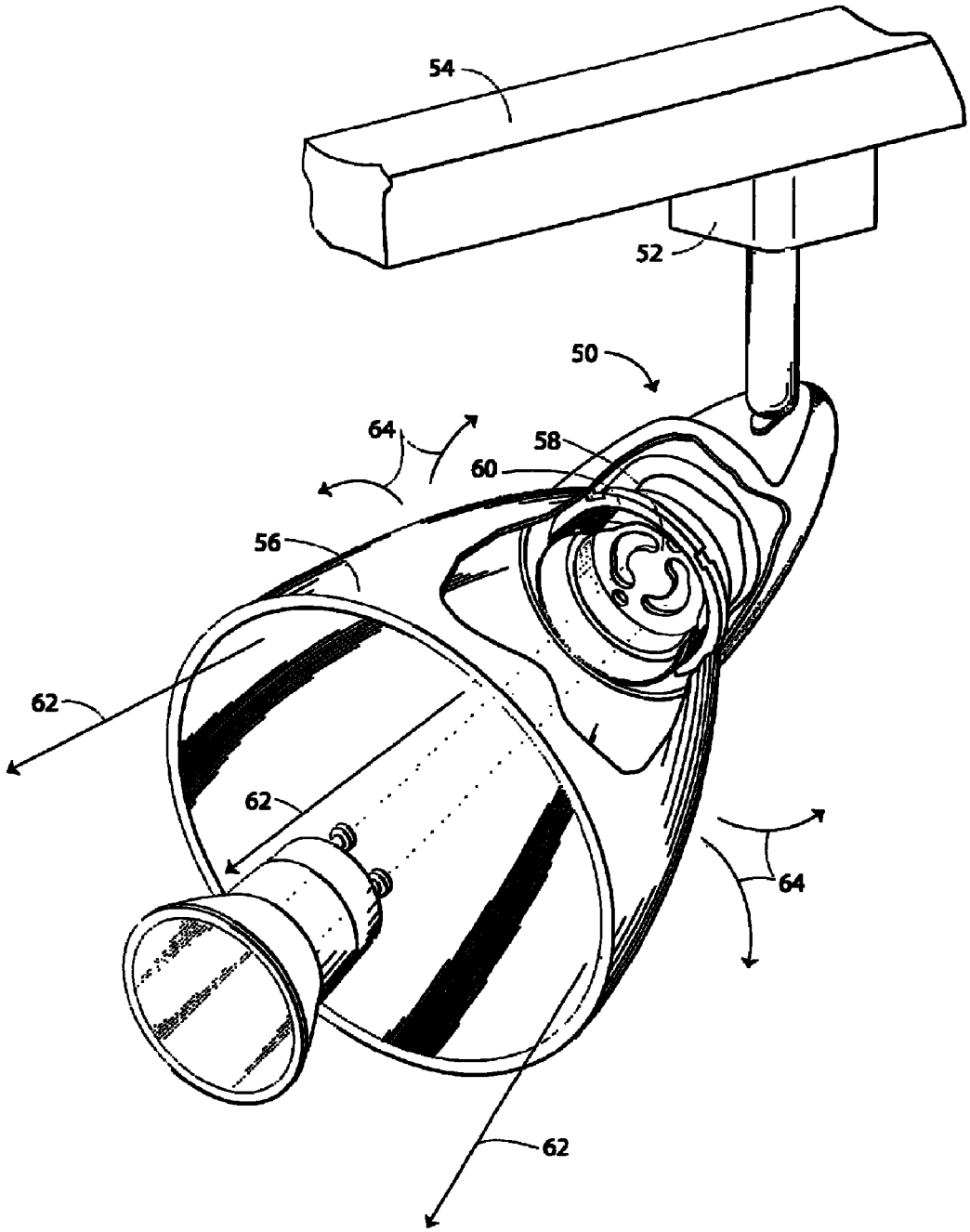
FIG. 2 is a perspective view of a track lighting fixture that uses the lamp illustrated in FIG. 1.

FIG. 2 is a perspective view illustrating a light fixture 50 selectively connected by a mounting bracket 52 to a track 54 for a track lighting fixture. The tracks and mounting brackets for track lighting fixtures are conventional and well known in the art, and no further detail is provided, except to note that the track and adapter provide for communication of electrical current from a supply of electricity to the lamp held in the lighting fixture. The illustrated lighting fixture 50 includes a shade 56 that mounts to a threaded socket 58 using a fastener 60. The shade 56 is a light translucent ceramic or glass shade. The socket 58 is configured for mating reception of the extending pins 42, 44 and feet 46, 48 for communication of electricity from the supply to the light capsule 28. The lamp 10 seats in the socket 58 in a conventional manner by inserting the feet 46 in slotted openings in the socket 58 and rotating the lamp 10 to seat the feet 46, 48 in narrowed flanged slots.

In operation, the lamp 10 emits focused light communicated from the reflector portion 16 substantially longitudinally as indicated by the arrows .62 through the open end of the shade 56. The lamp 10 further provides a generally omni-directional emission of light from the flood portion 18 through the shade 56 as indicated by the arrows 64.

The illustrated lamp 10 is exemplary and without limitation of lamps according to the present invention that exhibit both spot light and flood light characteristics. The reflector portion 16 complies with MR11 standards for a reflector lamp while in the base 24 and electrical contacts 42, 44 with the feet 44, 46 complies with GU10 standards. The contacts 42, 44 are disposed 10 mm (center-to-center) apart (70) extending 6 mm from the base (72). The shell has a outside diameter of 35 mm at the end 22 (74) and tapers to the diameter of 24 mm at the transition between the reflector portion 16 and the neck portion 18. The neck portion has a shallower taper to the diameter of 22 mm at the base 24. A distal end of the base 24 has a bevel edge 76 tapering to 15 mm. The reflector portion 16 and the neck portion are a combined length (78) of 27.5 mm, while the lamp has an overall length of 47.5 mm (80) from the end 22 to the extent of the feet 46, 48. The light source is tungsten-halogen operating at 120 volts AC and 20 watts with a color temperature of 2700° K.

The specification as described above the present invention that provides a lamp with combined spot light and flood light distribution properties useful with lighting fixtures, including the steps necessary for making and using various embodiments thereof. It is to be understood, however, that numerous changes and variations may be made in the construction of the lamp within the spirit and scope of the present invention and that modifications and changes may be made therein without departing from the scope thereof as set for the in the appended claims.

What is claimed is:

1. A lamp having structure that provides combined first and second functional light distribution properties, comprising:

an extended elongate translucent shell that allows light to pass through diffusely and enclosing a longitudinally extending interior cavity, the cavity having (a) a first portion with opposing ends having a first diameter and a second diameter in which the first diameter is greater than the second diameter, the first portion including a reflective coating on an interior surface of the shell so that light in the first portion of the cavity is directed by the reflective coating substantially longitudinally from an end of the shell; and (b) a second portion is frustroconical defined by opposing ends having the second diameter and a third diameter in which the second diameter is greater than the third diameter, said second portion lacking a reflective coating so that light in the second portion of the cavity emits diffusely in many directions from the second portion of the shell;

a socket-engaging base attached to the shell at a second end and including a pair of electrical contact members for communicating with respective electrical contacts of a socket of a light fixture; and an omni-directional light source disposed within the interior cavity and in electrical communication with the electrical contact members, whereby light emitted from the light source communicates in the first portion substantially longitudinally from the end of the shell and in the second portion diffusingly in many directions through the shell.

2. The lamp as recited in claim 1, further comprising a lens attached to an end of the first portion having the first diameter.

3. The lamp as recited in claim 2, wherein the electrical contact members each comprise a longitudinally extending member of a member diameter and terminated in a foot having a foot diameter, the member diameter differing from the foot diameter.

4. The lamp as recited in claim 3, wherein the light source comprises a halogen bulb.

5. The lamp as recited in claim 4, wherein the shell of the lamp is made from a frosted glass.

6. The lamp as recited in claim 1, wherein the electrical contact members each comprise a longitudinally extending member of a member diameter and terminated in a foot having a foot diameter.

7. The lamp as recited in claim 1, wherein the light source comprises a tungsten-halogen light source and further comprising a glass lens at a light emitting end of the shell.

8. The lamp as recited in claim 7, wherein a light emitting end of the first portion has a diameter of about 35 mm.

9. The lamp as recited in claim 8, wherein the electrical contact members are spaced apart on a center of about 10 mm.

10. The lamp as recited in claim 1, wherein the shell is made from a frosted glass material.

11. A track-light lamp having structure that provides combined functional spot and flood light distribution properties for emitting light longitudinally from an end of a translucent shade attached to a track-light fixture and for emitting light in many directions through the translucent shade, comprising:

an extended elongate shell defining an interior cavity, the wall of the shell being translucent to allow light to pass from the cavity through a wall of the shell to the exterior unless otherwise blocked, the shell having (a) a first frustroconical portion defined by a first end and an opposing second end with the first end having a larger diameter than the second end, the first frustroconical portion with a reflective coating on the wall of the shell so that light is directed substantially longitudinally from an end of the shell and not permitted to pass from the cavity through the shell in the first frustroconical portion; and (b) a second frustroconical portion defined by the second end of the first frustroconical portion and an opposing end of the second frustroconical portion with the second end having a larger diameter than the opposing end, the second frustroconical portion lacking a reflective coating so that light emits from the cavity through the shell in many directions;

a socket-engaging base attached to the opposing end of the second frustroconical portion and including a pair of electrical contact members for communicating with respective electrical contacts of a socket of a light fixture; and a lamp capsule having an omni-directional light source therein connected to a pair of electrical leads that extend therefrom and electrically connected to the pair of electrical contact members for communicating with a supply of electricity, said lamp capsule disposed within the interior cavity with a portion within the first frustronoical portion and a portion within the second frustroconical portion, whereby light emitted from the light source communicates diffusingly in many directions through the shell in the second frustroconical portion and substantially longitudinally from the first frustroconical portion.

12. The lamp as recited in claim 11, further comprising a lens covering the first end of the first frustroconical portion.

13. The lamp as recited in claim 11, wherein the electrical contact members each comprise a longitudinally extending member of a member diameter and terminated in a foot having a foot diameter.

14. The lamp as recited in claim 11, wherein the light source comprises a tungsten-halogen light source and further comprising a glass lens covering the first end of the first frustroconical portion of the shell.

15. The lamp as recited in claim 14, wherein the first end of the first frustroconical portion has a diameter of about 35 mm.

16. The lamp as recited in claim 15, wherein the electrical contact members are spaced apart on a center of about 10 mm.

17. The lamp as recited in claim 11, wherein the shell is made from a frosted glass material.

18. The lamp as recited in claim 1, wherein the first portion is frustroconical.

* * * * *